United States Patent [19]

Eibe

[11] Patent Number: 4,774,997

[45] Date of Patent: Oct. 4, 1988

[54] APPARATUS FOR EXTRUSION CASTING

[75] Inventor: Werner W. Eibe, McCandless Township, Allegheny County, Pa.

[73] Assignee: Blaw Knox Company, Pittsburgh, Pa.

[21] Appl. No.: 76,040

[22] Filed: Jul. 21, 1987

Related U.S. Application Data

[63] Continuation of Ser. No. 829,797, Feb. 14, 1986, Pat. No. 4,718,476.

[51] Int. Cl.[4] ..... B22D 11/20

[52] U.S. Cl. ..... 164/449; 164/413; 164/417; 148/2

[58] Field of Search ..... 164/415, 417, 418, 437, 164/459, 466, 471, 475, 476, 488, 489, 502, 505, 513, 413, 454, 449; 72/206; 148/2

[56] References Cited

U.S. PATENT DOCUMENTS

| | | | |
|---|---|---|---|
| 3,143,786 | 8/1964 | Jones | 72/206 |
| 3,340,716 | 9/1967 | Funk | 72/206 |
| 3,467,167 | 9/1969 | Mahin | 164/475 |
| 3,776,439 | 12/1973 | Settle | 164/155 |
| 3,830,282 | 8/1974 | Schultz | 164/415 |
| 3,901,305 | 8/1975 | Balevski et al. | 164/415 |
| 4,073,333 | 2/1978 | Korshunov et al. | 164/475 |

*Primary Examiner*—Nicholas P. Godici
*Assistant Examiner*—Richard K. Seidel
*Attorney, Agent, or Firm*—Webb, Burden, Ziesenheim & Webb

[57] ABSTRACT

This invention relates to formation of strip or other small sections by casting of metal and passing it through a sizing die. More particularly, the invention relates to production of metal strip by casting, by extruding the strip through a die and by rolling the extruded strip to a thinner gauge.

5 Claims, 4 Drawing Sheets

APPARATUS FOR EXTRUSION CASTING

This application is a continuation of application Ser. No. 829,797 for Method and Apparatus for Extrusion Casting, filed Feb. 14, 1986, now U.S. Pat. No. 4,718,476.

This invention relates to formation of strip or other small sections by casting of metal and passing it through a sizing die. More particularly, the invention relates to production of metal strip by casting, by extruding the strip through a die and by rolling the extruded strip to a thinner gauge.

The use of continuous casting machines, mostly for billets and slabs of over 75 millimeters thickness, has been well known for many years. Vertical strand, curved strand, and horizontal strand machines have all been used. Known equipment for casting steel slabs and billets has not been suitable for thin strip or small sections which present different problems and require different operating procedures.

It is now proposed to cast thin strip and the like having a thickness of less than 75 millimeters as produced by known equipment and yet more than about one millimeter thickness which is produced by some ultra thin casting units. I may also cast small sections other than thin strip using the same process and, for convenience, refer herein to such product, regardless of cross sections, as "strip". Preferably I cast a strip having thickness of about 5 millimeters. With a strip of that thickness there will be sufficient mechanical deformations by hot and by subsequent cold rolling to produce a material having excellent grain structure.

I heat metal to a liquid state and place the metal in a vessel having an outlet for the metal through a sozing die. I apply a pressure to the molten metal in the vessel sufficient to cause the metal to be extruded through the die. Intermittently, I lower the pressure in the vessel to a value which is below that required to cause metal movement through the mold and the die but which will continue to maintain pressure on metal in the mold. Thereafter, I increase the pressure to further extrude metal from the die. I apply pressure to the molten metal in the vessel by admitting gas under pressure to the vessel through an inlet valve and then closing the gas inlet valve, thereby allowing heat from the metal to heat the gas and increase the pressure thereof. I preferably pass molten metal from the vessel to the sizing die through a mold whose walls are chilled. I prefer to apply a pulsating pressure to the metal in the vessel whereby a pulsating movement of metal through the mold and die is produced. I further prefer to provide electromagnetic stirring of molten metal prior to the time it enters the mold and commences to freeze and solidify within the mold.

In conventional casters, pressure applied to the mold is due solely to the static head of the material. I prefer to provide a significant positive pressure within the vessel. The gas which supplies the pressure is prevented from escaping from the vessel by the gas valves. The flow of metal from the vessel is resisted by the sizing die and by friction between the mold and the metal. I prefer to increase the length of the mold and concurrently to increase the operating pressure in the vessel to the maximum practicable extent. Increasing the length of the mold increases the rate of production because a longer strand within the mold can be solidified for each stroke of material.

Preferably, I release gas introduced into the vessel containing molten metal and recycle the gas. I prefer to extract heat from said gas, preferably by generating steam in a heat exchanger.

After the metal passes from the sizing die, I pass the metal strip through a rolling mill in which the strip is reduced in gauge by rolling. I prefer to provide a slack accumulating loop between the die, and the rolling mill. Preferably, I provide pinch rolls which engage the strip on each side of the slack accumulating loop. I prefer to reheat the strip just prior to entry of the strip into the rolling mill, and preferably employ electric induction heating for that purpose. I prefer to coil the strip after rolling and to provide coiler means and shear means positioned to receive strip from the rolling mill. I also prefer to provide strip cooling means between the rolling mill and the shear means.

I prefer to provide a central controller which monitors the gas pressures at points in the system, the length of strip which issues from the sizing die and the amount of strip in the slack accumulating loop. I further prefer to use the central controller to regulate opening and closing of the valves associated with the pressure vessel, the operation of the induction stirring apparatus for the molten metal, driving of the pinch rolls associated with the slack accumulating rolls, regulating the strip induction heating means, and controlling operation of the rolling mill and coiler whereby a continuous production of strip from molten metal is maintained.

Other details, objects and advantages of my invention will become more apparent as the following description of a present preferred embodiment thereof proceeds.

In the accompanying drawings, I have illustrated a present preferred embodiment of my invention in which FIG. 1 is a schematic view of apparatus embodying and used to carry out my invention.

Figure 1:
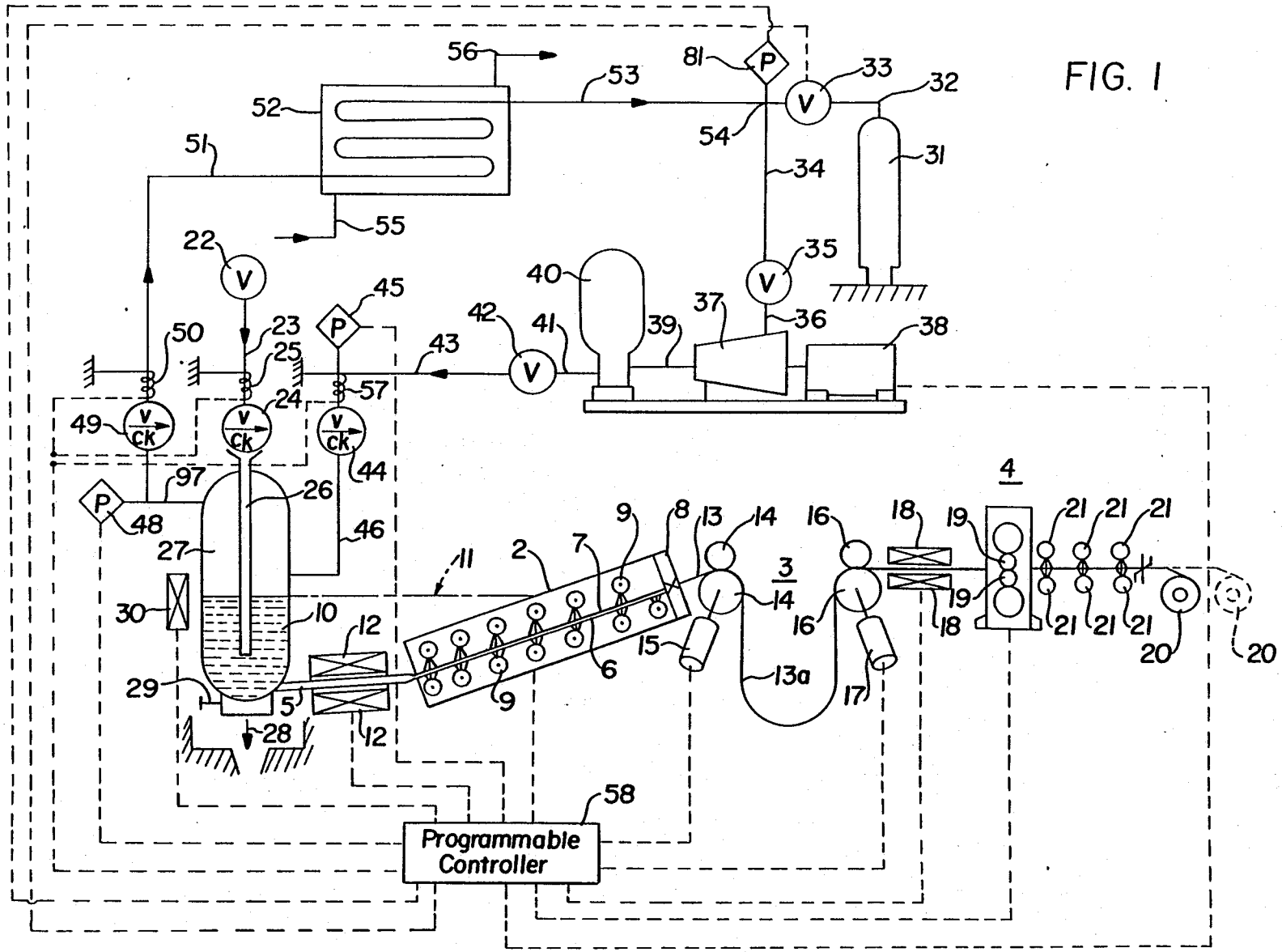

The apparatus includes a liquid metal pressure vessel 1, a mold and extrusion die assembly 2, a strip takeup loop 3, and a rolling mill 4. A duct 5 leads from the lower portion of pressure vessel 1 to a mold having walls 6 and 7 which are spaced apart approximately 5 millimeters. Walls 6 and 7 form an upwardly leading path from duct 5 to a sizing die 8. Spray nozzles 9 are positioned to spray water on the outside of mold walls 6 and 7. Liquid metal 10 is maintained in pressure vessel 1 at a level 11 or close thereto. It will be noted that level 11 is slightly below the opening of sizing die 8. Induction coils 12 are positioned above and below duct 5. When they are energized, the induction coils serve to stir and agitate metal which is within duct 5 between the coils.

Metal strip 13 which issues from sizing die 8 passes between pinch rolls 14 which are intermittently driven by a motor. The amount of rotation of rolls 14 is synchronized with the movement of strip from sizing die 8 so that the strip will not sag or be subjected to excess tensile forces between the sizing die and rolls 14. A tachometer generator 15 measures the extent of rotation of the rolls and delivers a proportional electrical signal. The strip passes through a further pair of pinch rolls 16 which are normally driven continuously by a motor. A tachometer generator 17 measures the extent of rotation of the rolls and delivers a proportional electrical signal which controls continuous operation of the rolling mill. Normally, there is slack in the strip between pinch rolls 14 and 16 with the result that the strip between them hangs in a loop 13*a*. The tension free loop and slack accumulator permits intermittent extrusion of strip from sizing die 8 and continuous operation of rolling mill 4. Induction heating coils 18 are positioned around the strip passline between pinch rolls 16 and rolling mill 4. Heating coils 18 reheat the strip and equalize its temperature in order to provide good rolling conditions. The passline goes between working rolls 19 to a down coiler 20. Spray nozzles 21 are provided to spray cooling water on strip issuing from the mill.

Liquid metal is supplied from a reservoir 22 or other source through a conduit 23 to a ceramic high temperature check valve 24. Check valve 24 is opened and closed by an electric coil 25. When valve 24 is opened, metal can flow from reservoir 22 to inlet tube 26 which leads through gas space 27 of pressure vessel 1 to the liquid level in the bottom. Metal may be discharged from the bottom of pressure vessel 1 at 28 by operating valve and wheel 29.

A liquid level indicator 30 is positioned along one side of pressure vessel 1. It determines the level of molten metal within the pressure vessel magnetically.

An inert gas such as argon is stored in a reservoir 31. A pipe 32 leads from reservoir 31 to a solenoid-operated remote control valve 33. Valve 33 also connects to a pipe 34 which leads to a hand-operated valve 35. A pipe 36 leads from valve 35 to a gas compressor 37. Compressor 37 is driven by an electric motor 38. A pipe 39 leads from the outlet of compressor 37 to a gas receiver 40. A pipe 41 leads from receiver 40 to a hand-operated valve 42. Pipe 43 leads from valve 42 to a high temperature solenoid-operated remote control valve 44. A pressure transducer 45 measures the pressure in pipe 43. Pipe 46 leads from valve 44 into pressure vessel 1.

An outlet pipe 47 is provided from pressure vessel 1. A transducer 48 measures the pressure in pipe 47 and also in pressure vessel 1. Pipe 47 leads to a high temperature solenoid-operated remote control valve 49 which is controlled by a coil 50. A pipe 51 leads from valve 49 to a heat exchanger 52 and to a pipe 53 which connects to pipe 34 at junction 54. A water inlet 55 and steam outlet 56 are provided in heat exchanger 52. A pressure transducer 81 measures the pressure at junction 54 and controls operation of valve 33 to replenish the system with gas from reservoir 31 when needed.

Valves 33, 49, 24, and 44 are all connected electrically to a programmable controller 58. The connections are indicated on the drawing by dotted lines. Other units connected to the controller are pressure transducers 45, 48 and 81, liquid level indicator 30, induction coils 12, tachometer generators 15 and 17, the drive motors for pinch rolls 14 and 16 and for rolling mill 4, and motor 38. The purpose of the controller is to operate the apparatus in the proper amount and in proper sequence as is explained hereinbelow.

Figure 2A:
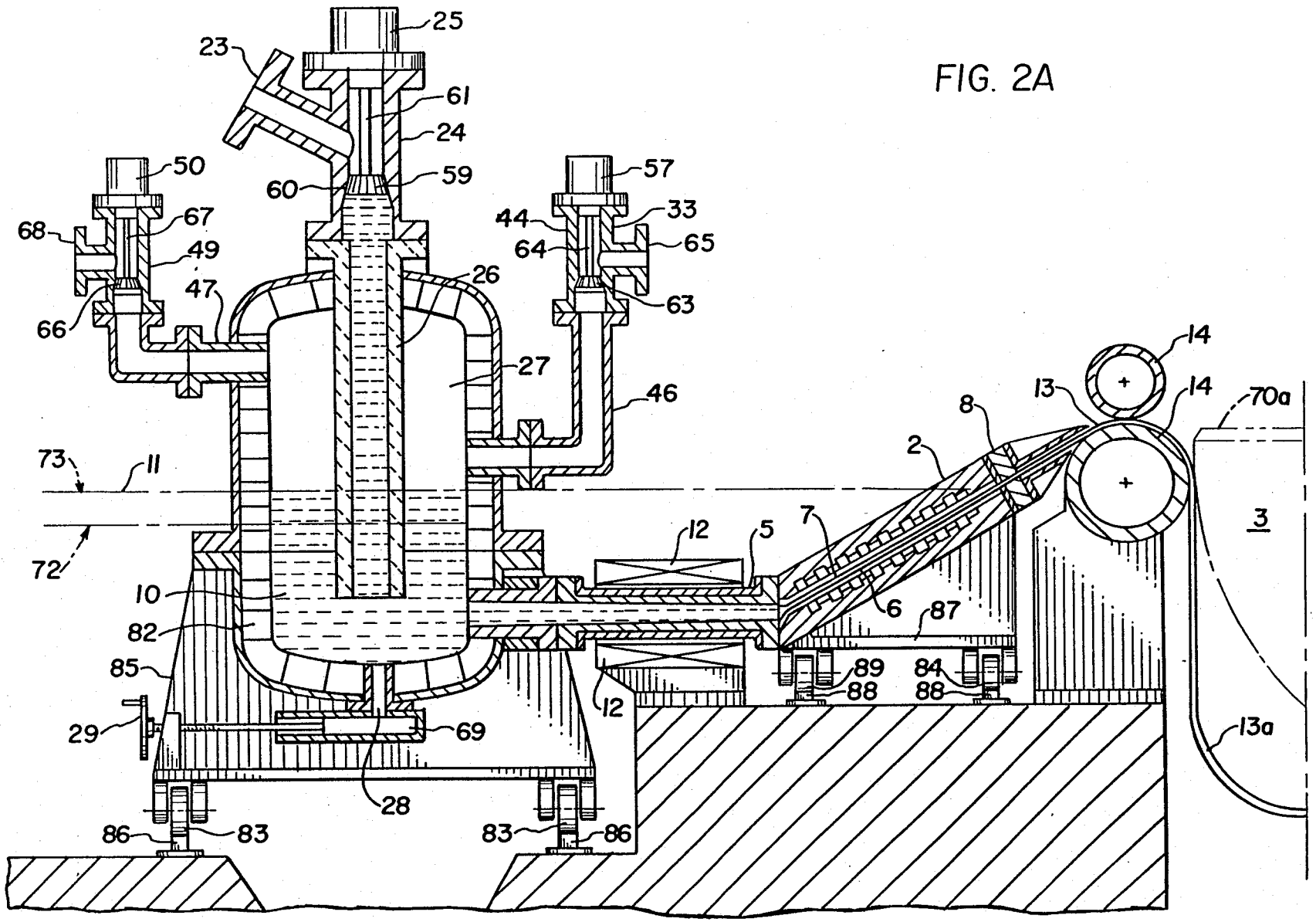
FIG. 2A is a simplified side view of the pressure vessel, mold, extrusion die, related pinch rolls, and part of the strip accumulating loop.
Figure 2B:
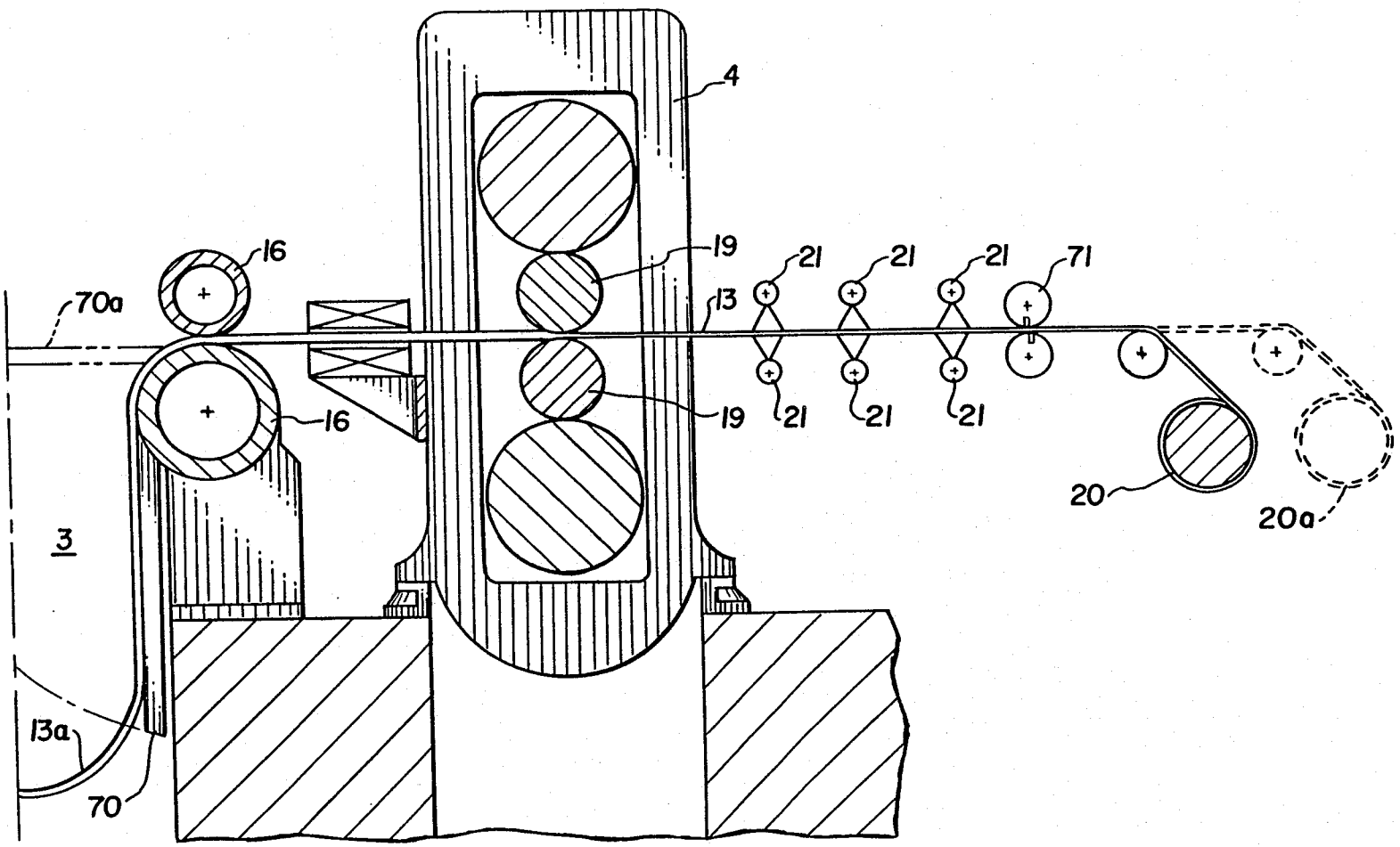
FIG. 2B is a continuation of FIG. 2A showing in simplified form part of the strip accumulating loop, the rolling mill and a downcoiler.
Figure 3:
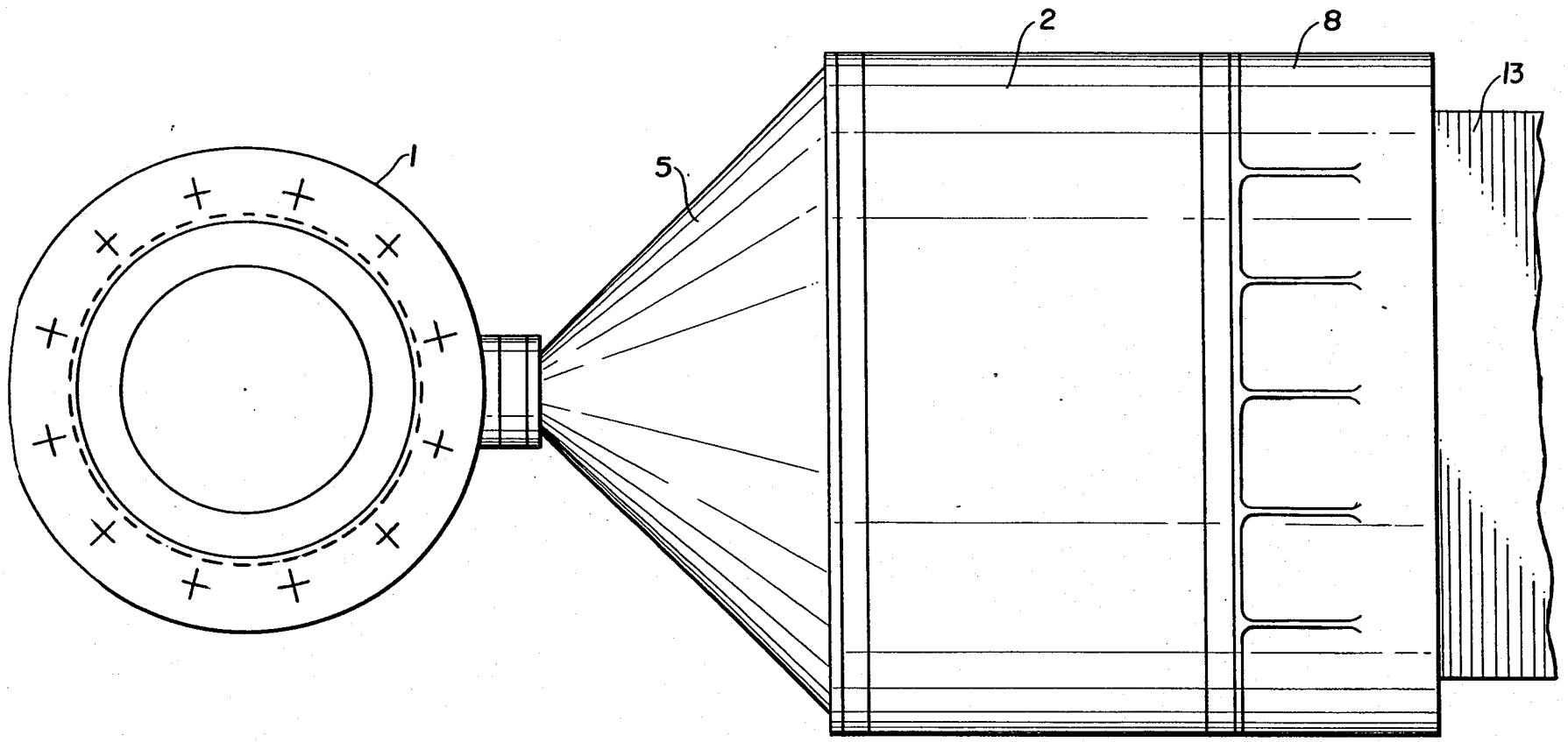
FIG. 3 is a simplified top plan view of pressure vessel, connecting duct, mold, and sizing die.

Those parts of the apparatus which handle the molten metal and the metal strip are shown in more detail in FIGS. 2A, 2B and 3. Pressure vessel 1 has a refractory lining 82 to withstand the heat of the molten metal. Valve 24 is made of ceramic or other high-temperature heat resistant material having a stopper 59 which engages a valve seat 60 and is mounted on stem 61 for travel up and down. When coil 25 is energized to move rod 61 down, stopper 59 moves away from valve seat 60 to allow liquid metal to flow into tube 26. A flange connects valve to a corresponding flange on pipe 23.

In the same manner, valve 44 has a ceramic stopper 63 mounted on a stem 64 for movement between open and closed positions. A flange 65 connects to a mating flange on pipe 43. Likewise, valve 49 has a ceramic stopper 66 mounted on a stem 67 for movement between open and closed positions. A flange 68 connects to a mating flange on pipe 51.

Metal outlet 28 is shown in greater detail in FIG. 2A. A ceramic block 69 is moved by operation of handwheel 29 to open or close the bottom outlet from pressure vessel 1. Outlet 28 is used to empty molten metal from the pressure vessel when the casting process is interrupted.

In FIG. 1, mold 2 is shown schematically cooled by water sprays. FIG. 2A shows an alternate arrangement in which mold walls 6 and 7 are backed up by water passages instead of water sprays.

Pressure vessel 1 is mounted on a frame 85 which is supported by wheels 3 which roll on tracks 86 mounted on the foundation. Mold 2 and sizing die 8 are mounted on a frame 87 which is supported by wheels 84 which roll on tracks 88 mounted on the foundation. By disconnecting flanges 23, 65, and 68, the entire assembly of pressure vessel, mold and sizing die can be moved to one side of the line for relining and other maintenance, and a second unit can be moved into position to permit production to be resumed without further delay.

A retractable table 70 is positioned below pinch rolls on a pivotal mounting. It may be rotated on its pivotal mounting to position 70*a* (shown in chain line) to guide the leading end of strip from rolls 14 to rolls 16. After the leading end of the strip is engaged by rolls 16, table 70 is returned to inactive position as shown in FIG. 2*a*.

A rotary shear 71 of conventional design is provided to shear the moving strip after it passes the cooling spray nozzles 21. In continuous operation the strip will be guided to a second down coiler 20*a* after shearing.

In operation, pressure vessel 1 is filled to a proper level 11 with molten metal by energizing coil 25 and opening valve 24. When metal rises to level 11, level indicator 30 senses that the proper level has been reached and sends a signal to controller 58 which energizes valve 24 to close. The controller then energizes coil 57 to open valve 44. Argon gas under pressure in gas receiver 40 flows through pipes 41, 43, and 46 into pressure vessel 1. Transducer 48 measures the pressure of the incoming gas and sends an electrical signal to the controller. When the pressure in pressure vessel 1 reaches a desired level, controller 58 activates coil 57 to close valve 44. The gas which has been introduced into pressure vessel 1 will be heated by the molten metal causing a pressure rise within the vessel to a multiple of the original pressure. The pressure forces molten metal through duct 5 and into mold 6 and outwardly through sizing die 8. Before increase of pressure, molten metal being stationary in mold 2 is chilled by the water sprays on the outside of mold 2 and will solidify to form a strip. The increase in pressure pushes the solidified strip out through sizing die 8 and between pinch rolls 14. Tachometer generator 15 delivers a signal to controller 58 indicating the amount of strip which has been extruded through sizing die 8. When the length of strip is a little less than the length of mold 2, controller 15 energizes coil 50 to open valve 49 and allow gas to escape from pressure vessel 1. The pressure of gas in pressure vessel 1 is indicated by transducer 48 which sends a corresponding signal to controller 58. When the pressure is below that required to move metal through mold 2 and sizing die 8, controller 58 will cause valve 49 to close. The new charge of molten metal in mold 2 is held just long enough for the metal to freeze under residual pressure, and then the cycle is repeated. Normally, freezing will take place within a few seconds. The lower level of liquid metal in pressure vessel 1 is shown by line 72, and the rise and fall of liquid metal is the distance 73 between lines 11 and 72. After the level of expired metal falls a distance 73, new metal is introduced into this pressure vessel through valve 24.

Strip 13 falls in a loop 13*a* between pinch rolls 14 and 16. Strip is extracted from sizing die 8 and added to loop 13*a* intermittently. Strip is pulled from loop 13*a* between rolls 16 and between heating coils 18 by rolling mill 4 continuously. Accordingly, the size of loop 13*a* regularly increases and decreases. The speed of the mill is controlled by controller 58 which operates the mill at a speed to keep a loop 13*a* of desired size between pinch rolls 14 and 16. The strip is reheated and temperature equalized by heaters 18 in a controlled amount. The amount of heat which is added is proportioned to the speed of travel of the strip so that the strip will enter mill 4 at a substantially constant temperature.

After rolling, the strip is cooled by water sprays and is coiled on a downcoiler in a conventional manner.

Induction coils 12 act to stir molten metal in duct 5 and to prevent segregation or stratification. Thus, the metal which is delivered to mold 6 is homogeneous. The continued maintenance of pressure in pressure vessel 1 causes the molten metal to be solidified under pressure, thereby promoting dense metallic structure in the strip. The cyclical heat exchange from the hot metal to the gas in pressure vessel 1 increases the speed of solidification of the metal and thereby increases the rate of production.

Hot gas from pressure vessel 1 which is vented from valve 49 passes through pipe 51 to heat exchanger 52. Water introduced through pipe 55 is converted to steam which is delivered from heat exchanger through pipe 56. The steam may be used for process elsewhere in the plant, for power generation, or driving a turbine and the compressor of this system. Cool gas from heat exchanger 52 is delivered through pipe 53 to junction 54 where it will pass to reservoir 31 or to compressor 37 through pipes 34 and 36. Motor 38 is driven to compress gas and to maintain gas receiver 40 at a desired pressure as shown by pressure transducer 45.

It will be apparent from the foregoing that the process is one in which liquid metal is repetitively added at intervals, the metal is repetitively cooled and extruded at intervals, and strip is rolled and coiled continuously there. As a whole, therefore, the process is a continuous one in which some parts are intermittent and repetitive.

While I have illustrated and described a present preferred embodiment of my invention, it is to be understood that I do not limit myself thereto and that my invention may be otherwise variously practiced within the scope of the following claims.

I claim:

1. Apparatus for continuous metal strip production comprising a pressure vessel adapted to hold liquid metal, liquid metal supply means connected therewith through a first valve, pressurized gas means connected with said pressure vessel through a second valve, pressurized gas venting means connected with said pressure vessel through a third valve, gas pressure measuring means connected with said pressure vessel, elongated upwardly inclined mold means in flow connection with the bottom of the pressure vessel, cooling fluid supply means positioned adjacent said mold so as to solidfy said liquid metal therein rapidly along its length, measuring means at the exit of said mold adapted to measure the lengths of metal strips exiting therefrom, and controller means connected with said gas pressure measuring means, said strip length measuring means, and said valves, so as to admit metal and pressurizing gas to said pressure vessel to a pressure sufficient to cause molten metal to enter said mold to solidify therein and exit as solid strip, to relieve pressure when a solid strip of desired length has been extruded, and to repeat that cycle.

2. Apparatus of claim 1 including means connected to said controller means for determining the level of molten metal in said pressure vessel, whereby said controller closes said first valve at a pre-determined metal level.

3. Apparatus of claim 1 in which said controller is adjusted to admit molten metal and pressurized gas to said pressure vessel and to open said venting means when the pressure in said pressure vessel reaches a pre-determined value.

4. Apparatus of claim 1 including a rolling mill positioned to receive hot metal strip from said mold and controlled by said controller means, those controller means being adapted to control said mill speed so that strip entering said rolling mill from said mold is not tensioned thereby.

5. Apparatus of claim 4 including accumulating means between said mold and said rolling mill, and in which said controller means is adjusted to maintain slack hot strip in said accumulating means, whereby strip exiting intermittently from said mold is delivered continuously to said mill.

* * * * *

UNITED STATES PATENT AND TRADEMARK OFFICE

CERTIFICATE OF CORRECTION

PATENT NO. : 4,774,997

DATED : October 4, 1988

INVENTOR(S) : Werner W. Eibe

It is certified that error appears in the above-identified patent and that said Letters Patent is hereby corrected as shown below:

Column 1 Line 35 "sozing" should read --sizing--.

Column 6 Line 2 "there" should read --therefrom--.

Signed and Sealed this

Twenty-seventh Day of June, 1989

*Attest:*

DONALD J. QUIGG

*Attesting Officer*

*Commissioner of Patents and Trademarks*